US009685693B2

(12) United States Patent
Kanj et al.

(10) Patent No.: US 9,685,693 B2
(45) Date of Patent: Jun. 20, 2017

(54) MULTI-ANTENNA SYSTEM FOR MOBILE HANDSETS WITH A PREDOMINANTLY METAL BACK SIDE

(71) Applicant: BLACKBERRY LIMITED, Waterloo (CA)

(72) Inventors: Houssam Kanj, Waterloo (CA); Shirook M. Ali, Waterloo (CA)

(73) Assignee: BLACKBERRY LIMITED, Waterloo, Ontario (CA)

( * ) Notice: Subject to any disclaimer, the term of this patent is extended or adjusted under 35 U.S.C. 154(b) by 285 days.

(21) Appl. No.: 14/486,685

(22) Filed: Sep. 15, 2014

(65) Prior Publication Data

US 2016/0079653 A1 Mar. 17, 2016

(51) Int. Cl.

| | |
|---|---|
| ***H01Q 1/24*** | (2006.01) |
| ***H01Q 1/48*** | (2006.01) |
| ***H01Q 1/52*** | (2006.01) |
| ***H01Q 21/28*** | (2006.01) |

(52) U.S. Cl.

CPC ..... *H01Q 1/243* (2013.01); *H01Q 1/48* (2013.01); *H01Q 1/521* (2013.01); *H01Q 21/28* (2013.01)

(58) Field of Classification Search

CPC ..... H01Q 1/243; H01Q 1/48; H01Q 1/521; H01Q 5/364; H01Q 21/28

USPC ..... 343/702, 700 MS

See application file for complete search history.

(56) References Cited

U.S. PATENT DOCUMENTS 4,162,499 A * 7/1979 Jones, Jr. ..... H01Q 5/42 343/700 MS
2008/0012774 A1* 1/2008 Wang ..... H01Q 1/243 343/702
2008/0316120 A1* 12/2008 Hirota ..... H01Q 1/2258 343/702
2009/0153407 A1* 6/2009 Zhang ..... H01Q 1/243 343/702
2009/0207092 A1* 8/2009 Nysen ..... H01Q 1/2275 343/876

(Continued)

FOREIGN PATENT DOCUMENTS

WO WO-2010025023 A2 3/2010

OTHER PUBLICATIONS

Extended European Search Reprt dated Feb. 12, 2016 for European Patent Application No. 15184728.2.

*Primary Examiner* — Dameon E Levi
*Assistant Examiner* — Ab Salam Alkassim, Jr.
(74) *Attorney, Agent, or Firm* — Perry + Currier, Inc.

(57) ABSTRACT

A device with a predominantly metal back side is provided. The device comprises: a non-conducting chassis having an interior and an exterior; at least one exterior radiating arm on the exterior of the chassis and a respective microstrip line located on the interior of the chassis, the exterior radiating arm and the microstrip electrically connected through the chassis, the exterior radiating arm and microstrip configured to resonate together in a first frequency range; and, at least one interior radiating arm located, and configured to resonate in one or more second frequency ranges higher than the first frequency range; a ground plane located on the exterior of the chassis, each of the exterior radiating arms and the ground plane being electrically separated from each other on the exterior of the chassis; and, one or more antenna feeds configured to connect to each of the microstrips and interior radiating arms.

20 Claims, 7 Drawing Sheets

(56) References Cited

U.S. PATENT DOCUMENTS

| | | | | |
|---|---|---|---|---|
| 2010/0053002 | A1* | 3/2010 | Wojack | H01Q 9/42 343/702 |
| 2011/0128190 | A1* | 6/2011 | Galeev | H01Q 1/243 343/702 |
| 2011/0215971 | A1* | 9/2011 | Rao | H01Q 1/243 343/702 |
| 2011/0316751 | A1* | 12/2011 | Jarvis | H01Q 1/243 343/702 |
| 2012/0223865 | A1* | 9/2012 | Li | H01Q 9/42 343/702 |
| 2013/0002510 | A1* | 1/2013 | Azulay | H01Q 1/243 343/860 |
| 2013/0069836 | A1* | 3/2013 | Bungo | H01Q 1/243 343/724 |
| 2013/0257659 | A1* | 10/2013 | Darnell | H01Q 1/243 343/702 |
| 2014/0009355 | A1* | 1/2014 | Samardzija | H01Q 1/42 343/789 |
| 2014/0078003 | A1* | 3/2014 | Lin | H01Q 1/243 343/700 MS |
| 2014/0125528 | A1* | 5/2014 | Tsai | H01Q 13/106 343/702 |
| 2015/0138020 | A1* | 5/2015 | Khobragade | H01Q 1/243 343/702 |

* cited by examiner

MULTI-ANTENNA SYSTEM FOR MOBILE HANDSETS WITH A PREDOMINANTLY METAL BACK SIDE

FIELD

The specification relates generally to antennas, and specifically to a multi-antenna system for mobile handsets with a predominantly metal back side.

BACKGROUND

The current mobile device market prefers slimmer and more stylish phones. For example, people like phones with a high aspect screen ratio with lots of metals running around and on the back like a metal ring and/or a full metal back. Further, slim designs lead to small and/or tight internal spaces which pose challenges to the antenna engineer as generally more space and clearance are preferred in order to put an antenna with high performance in a mobile phone. Further, with the inclusion of the metal ring or the metal back, the antenna performance will deteriorate. One solution is to use a surrounding metal ring as a main antenna, however, as has been widely publicized, this can also be a big problem: i.e., when such a phone is held in a certain way, the phone can lose signal reception. In another solution, a metal ring can be etched at the bottom of a mobile phone onto a piece of plastic matched in color so that the antenna performance can be preserved.

Apart from the increasing demand for a "better-looking" phone, there can also be standards issues to take into account when designing antennas. For example, in "next generation" LTE (Long Term Evolution) high-speed data transmission networks, mobile devices should include antennas that resonate at frequency bands: 698 MHz-746 MHz and 746 MHz-798 MHz (the LTE700 band). An LTE antenna should hence theoretically have a larger electrical size than a Global System for Mobile Communications)/CDMA (Code Division Multiple Access)/PCS (Personal Communications Service)/UMTS (Universal Mobile Telecommunications System) antenna, since an LTE antenna resonates at a lower frequency. However, with fashion trends of mobile phones being towards "slimmer and lighter", it is challenging to get a LTE antenna into such trendy devices that still have adequate performance.

BRIEF DESCRIPTIONS OF THE DRAWINGS

For a better understanding of the various implementations described herein and to show more clearly how they may be carried into effect, reference will now be made, by way of example only, to the accompanying drawings in which.

DETAILED DESCRIPTION

Figure 1:
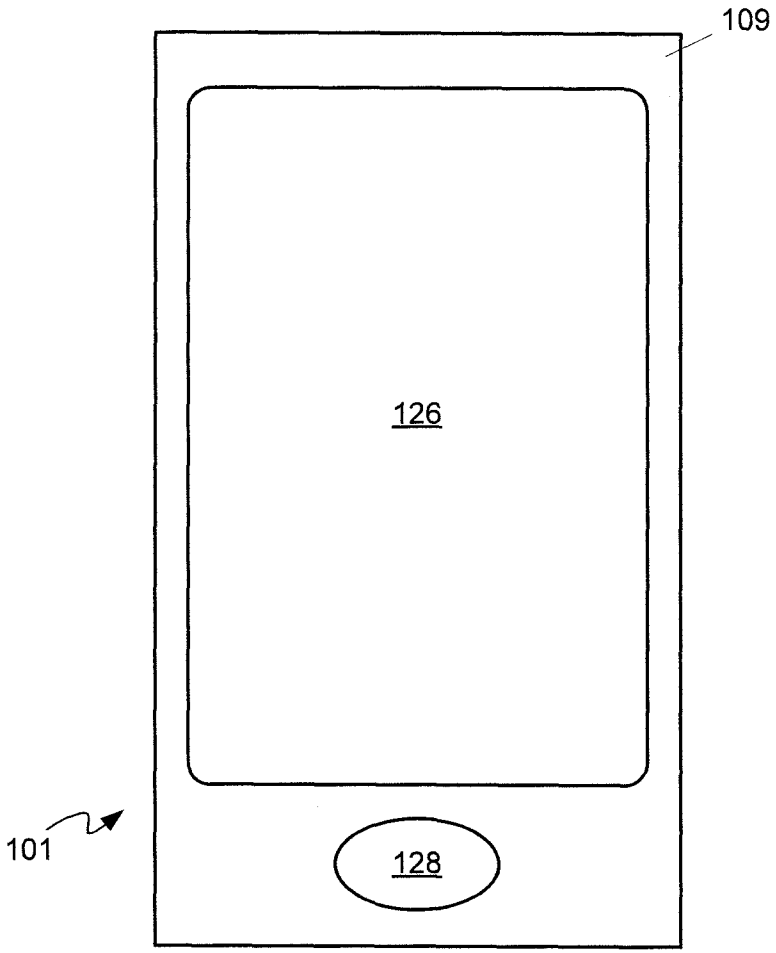
FIG. 1 depicts a front perspective view of a device that includes a multi-antenna system for mobile handsets with a predominantly metal back side, according to non-limiting implementations.

The present disclosure describes examples of devices with a "full" metal back side and/or a back cover that is predominantly metal and/or predominantly conducting, and optionally a USB (Universal Serial Bus) port. Included in devices described herein are four antennas. A first antenna that operates as a main multi-band. A second antenna that operates as a diversity multi-band antenna. Each of the first antenna and the second antenna comprise respective external radiating arm (and/or metal strips) located on an exterior of a back side of a device, connected to one or more antenna feeds via respective microstrip lines on an interior of the back side; each of the first antenna and the second antenna further comprise respective one or more internal radiating arms located inside the device. The external radiating arms, together with the microstrips, operate as a low band antenna, while the internal radiating arms operate as mid-band and high-band antennas. The back side further comprises ground plane between the first and second antennas that is electrically separated there from.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

Furthermore, as will become apparent, in this specification certain elements may be described as connected physically, electronically, or any combination thereof, according to context. In general, components that are electrically connected are configured to communicate (that is, they are capable of communicating) by way of electric signals. According to context, two components that are physically coupled and/or physically connected may behave as a single element. In some cases, physically connected elements may be integrally formed, e.g., part of a single-piece article that may share structures and materials. In other cases, physically connected elements may comprise discrete components that may be fastened together in any fashion. Physical connections may also include a combination of discrete components fastened together, and components fashioned as a single piece.

Furthermore, as will become apparent in this specification, certain antenna components may be described as being configured for generating a resonance at a given frequency and/or resonating at a given frequency and/or having a resonance at a given frequency. In general, an antenna component that is configured to resonate at a given frequency, and the like, can also be described as having a resonant length, a radiation length, a radiating length, an electrical length, and the like, corresponding to the given frequency. The electrical length can be similar to, or different from, a physical length of the antenna component. The electrical length of the antenna component can be different from the physical length, for example by using electronic components to effectively lengthen the electrical length as compared to the physical length. The term electrical length is most often used with respect to simple monopole and/or dipole antennas. The resonant length can be similar to, or different from, the electrical length and the physical length of the antenna component. In general, the resonant length corresponds to an effective length of an antenna component used to generate a resonance at the given frequency; for example, for irregularly shaped and/or complex antenna components that resonate at a given frequency, the resonant length can be described as a length of a simple antenna component, including but not limited to a monopole antenna and a dipole antenna, that resonates at the same given frequency.

An aspect of the specification provides a device comprising: a back side comprising a non-conducting chassis having an interior and an exterior; a first exterior radiating arm located on the exterior of the non-conducting chassis and a first microstrip line located on the interior of the non-conducting chassis, the first exterior radiating arm and the first microstrip line electrically connected through the non-conducting chassis, the first exterior radiating arm and the first microstrip line configured to resonate together in a first frequency range; a first interior radiating arm located inside the device, and configured to resonate in one or more second frequency ranges higher than the first frequency range; a second exterior radiating arm located on the exterior of the non-conducting chassis and a second microstrip line located on the interior of the non-conducting chassis, the second exterior radiating arm and the second microstrip line electrically connected through the non-conducting chassis, the second exterior radiating arm and second microstrip line configured to resonate together in the first frequency range; a second interior radiating arm located inside the device, and configured to resonate in the one or more of second frequency ranges; a ground plane located on the exterior of the non-conducting chassis, each of the first exterior radiating arm, the second exterior radiating arm and the ground plane being electrically separated from each other on the exterior of the non-conducting chassis; and, one or more antenna feeds configured to connect to each of the first microstrip line the second microstrip line, the first interior radiating arm and the second interior radiating arm.

The ground plane can separate the first exterior radiating arm from the second exterior radiating arm.

The device can further comprise one or more of a port and a USB (Universal Serial Bus) port through a side of the device, the first interior radiating arm and the second interior radiating arm located on either side of the one or more of the port and the USB port on an interior of the device.

Each of the first interior radiating arm and the second interior radiating arm can comprise a respective inverted L-monopole antenna.

Each of the first interior radiating arm and the second interior radiating arm can be located on an interior chassis.

Each of the first interior radiating arm and the second interior radiating arm can be located on the interior of the non-conducting chassis.

Each of the first interior radiating arm and the second interior radiating arm can comprise a respective PIFA (Planar Inverted-F Antenna).

One or more of the first exterior radiating arm and the second exterior radiating arm can be configured as a ground plane for the respective PIFA.

Each of the first interior radiating arm and the second interior radiating arm can be configured to resonate in one or more of: a GSM (Global System for Mobile Communications) frequency range; a CDMA (Code Division Multiple Access) frequency range; a PCS (Personal Communications Service) frequency range; and a UMTS (Universal Mobile Telecommunications System) frequency range.

The ground plane can comprise a parasitic ground plane.

The ground plane can be electrically connected to a grounding portion of the one or more antenna feeds when the back side is in a use position at the device.

The device can further comprise an internal chassis, the one or more antenna feeds are located at the internal chassis and are connected to the first microstrip line and the second microstrip line via respective spring contacts when the back side is in a use position with respect to the internal chassis.

Opposite ends of one or more of the first exterior radiating arm and the second exterior radiating arm can be connected using a respective conducting strip, the respective conducting strip located on the interior of the non-conducting chassis.

The first exterior radiating arm and the first microstrip line can be electrically connected through the non-conducting chassis at about a centre of the first exterior radiating arm, and the second exterior radiating arm and the second microstrip line can be electrically connected through the non-conducting chassis at about a respective centre of the second exterior radiating arm.

Each of the first exterior radiating arm and the second exterior radiating arm can comprise respective cap monopole antennas.

The first frequency range can comprise one or more of: a frequency range of about 698 MHz to about 960 MHz; an LTE (Long-Term Evolution) frequency range; and LTE700 frequency range; and the one or more second frequency ranges can comprise one or more of: about 1710 to about 2100 MHz, about 2300 to about 2700 MHz one or more GSM (Global System for Mobile Communications) frequency ranges; one or more CDMA (Code Division Multiple Access) frequency ranges; one or more PCS (Personal Communications Service) frequency ranges; and one or more UMTS (Universal Mobile Telecommunications System) frequency ranges.

The device can further comprise one or more switches configured to switch between using one of a first combination of the first exterior radiating arm and the first microstrip line, and a second combination of the second exterior radiating arm as a main antenna, and the other of the first combination and the second combination as a diversity antenna, in a low-band mode.

The device can further comprise one or more switches configured to switch between using the first interior radiating arm and the second interior radiating arm as a main antenna and the other of the first interior radiating arm and the second interior radiating arm as a diversity antenna, in one or more of a mid-band mode and a high-band mode.

The device can further comprise a processor configured to switch between a low-band mode and one or more of a mid-band mode and a high-band mode.

Exposed portions of the non-conducting chassis, the first exterior radiating arm, the second exterior radiating arm, and the ground plane can be colour matched.

Figure 2:
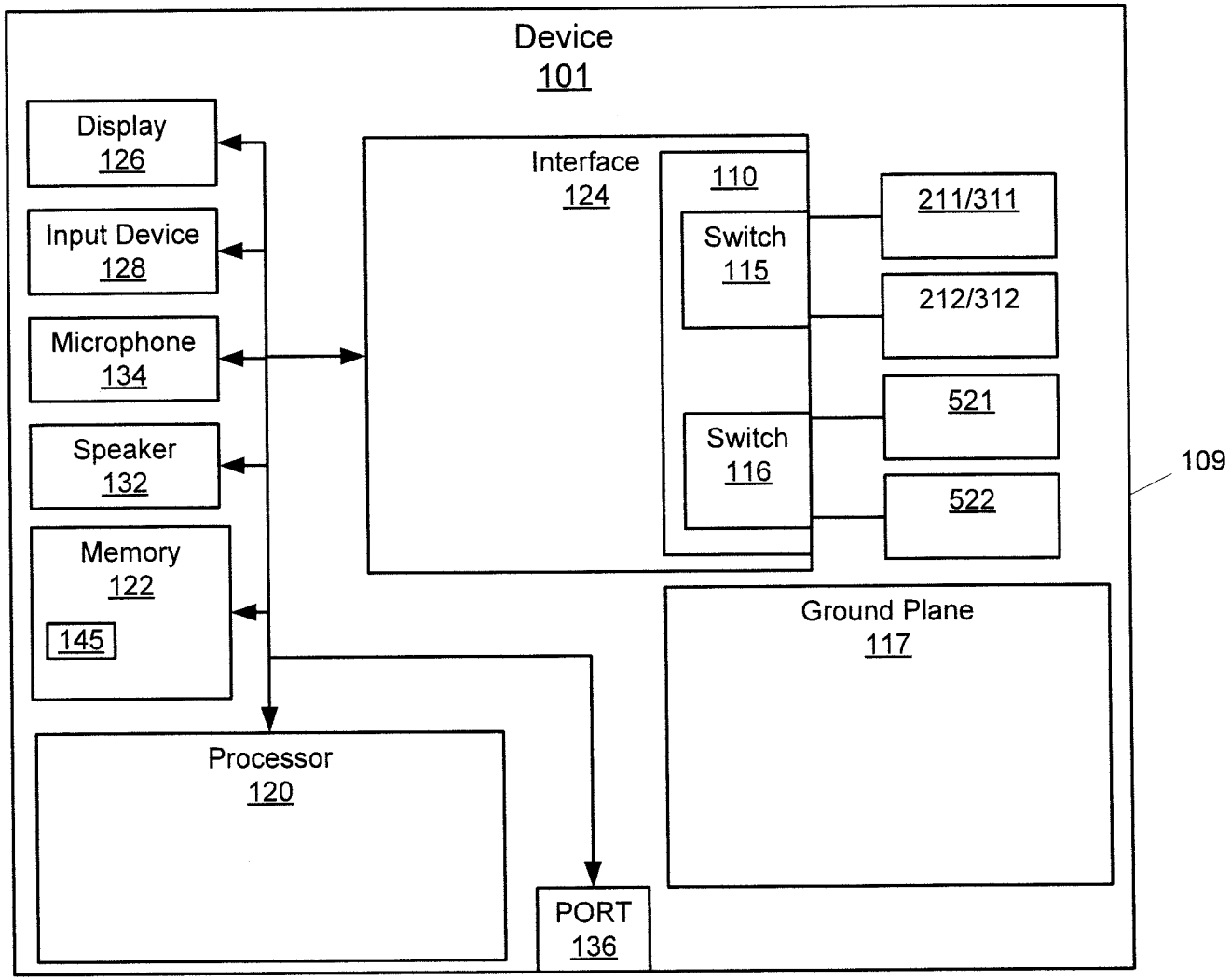
FIG. 2 depicts a schematic diagram of the device of FIG. 1, according to non-limiting implementations.

FIGS. 1 and 2 respectively depict a front perspective view and a schematic diagram of a mobile electronic device 101, referred to interchangeably hereafter as device 101. Device 101 comprises: a chassis 109; one or more antenna feeds 110, a first combination of first exterior radiating arm 211 and a first microstrip line 311, a second combination of a second exterior radiating arm 212 and a second microstrip line 312; interior radiating arms 521, 522; one or more switches 115, 116 configured to respectively switch between the first combination and the second combination in a low-band mode, and a switch between interior radiating arms 521, 522 in a mid-band mode and/or high band mode; and a ground plane 117. Physical configurations of device 101, radiating arms 211, 212, 521, 522 and microstrip lines 311, 312 and ground plane 117 will be described in further detail below.

Device 101 can be any type of electronic device that can be used in a self-contained manner to communicate with one or more communication networks using radiating arms 211, 212, 521, 522 and microstrip lines 311, 312. Device 101 can include, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances and the like. Other suitable devices are within the scope of present implementations. Device 101 hence further comprise a processor 120, a memory 122, a display 126, a communication interface 124 that can optionally comprise antenna feed 110 and/or switches 115, 116, at least one input device 128, a speaker 132 and a microphone 134.

It should be emphasized that the shape and structure of device 101 in FIGS. 1 and 2 are purely examples, and contemplate a device that can be used for both wireless voice (e.g. telephony) and wireless data communications (e.g. email, web browsing, text, and the like). However, FIG. 1 contemplates a device that can be used for any suitable specialized functions, including, but not limited, to one or more of, telephony, computing, appliance, and/or entertainment related functions.

With reference to FIG. 1, an exterior of device 101 is depicted with a front portion of chassis 109, the corners of chassis 109 being generally square though, in other implementations, the corners can be rounded and/or any other suitable shape; indeed, the shape and configuration of device 101 depicted in FIG. 1 is merely an example and other shapes and configurations are within the scope of present implementations.

With reference to FIGS. 1 and 2, device 101 comprises at least one input device 128 generally configured to receive input data, and can comprise any suitable combination of input devices, including but not limited to a keyboard, a keypad, a pointing device (as depicted in FIG. 1), a mouse, a track wheel, a trackball, a touchpad, a touch screen and the like. Other suitable input devices are within the scope of present implementations.

Input from input device 128 is received at processor 120 (which can be implemented as a plurality of processors, including but not limited to one or more central processors (CPUs)). Processor 120 is configured to communicate with a memory 122 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of device 101 as described herein are typically maintained, persistently, in memory 122 and used by processor 120 which makes appropriate utilization of volatile storage during the execution of such programming instructions. Those skilled in the art will now recognize that memory 122 is an example of computer readable media that can store programming instructions executable on processor 120. Furthermore, memory 122 is also an example of a memory unit and/or memory module.

Memory 122 further stores an application 145 that, when processed by processor 120, enables processor 120 to control switches 115, 116 to switch between radiating arms 211, 212, 521, 522 and microstrip lines 311, 312, depending on a mode of device 101 and which respective combinations of antenna components are to be used as a main antenna and as a diversity antenna. Furthermore, memory 122 storing application 145 is an example of a computer program product, comprising a non-transitory computer usable medium having a computer readable program code adapted to be executed to implement a method, for example a method stored in application 145.

Processor 120 can be further configured to communicate with display 126, and microphone 134 and speaker 132. Display 126 comprises any suitable one of, or combination of, flat panel displays (e.g. LCD (liquid crystal display), plasma displays, OLED (organic light emitting diode) displays, capacitive or resistive touchscreens, CRTs (cathode ray tubes) and the like. Microphone 134 comprises any suitable microphone for receiving sound and converting to audio data. Speaker 132 comprises any suitable speaker for converting audio data to sound to provide one or more of audible alerts, audible communications from remote communication devices, and the like. In some implementations, input device 128 and display 126 are external to device 101, with processor 120 in communication with each of input device 128 and display 126 via a suitable connection and/or link.

Processor 120 also connects to communication interface 124 (interchangeably referred to as interface 124), which can be implemented as one or more radios and/or connectors and/or network adaptors, configured to wirelessly communicate with one or more communication networks (not depicted) via radiating arms 211, 212, 521, 522 and microstrip lines 311, 312. It will be appreciated that interface 124 is configured to correspond with network architecture that is used to implement one or more communication links to the one or more communication networks, including but not limited to any suitable combination of USB (universal serial bus) cables, serial cables, wireless links, cell-phone links, cellular network links (including but not limited to 2 G, 2.5 G, 3 G, 4 G+ such as UMTS (Universal Mobile Telecommunications System), GSM (Global System for Mobile Communications), CDMA (Code division multiple access), FDD (frequency division duplexing), LTE (Long Term Evolution), TDD (time division duplexing), TDD-LTE (TDD-Long Term Evolution), TD-SCDMA (Time Division Synchronous Code Division Multiple Access) and the like, wireless data, Bluetooth™ links, NFC (near field communication) links, WLAN (wireless local area network) links, WiFi links, WiMax links, packet based links, the Internet, analog networks, the PSTN (public switched telephone network), access points, and the like, and/or a combination.

Specifically, interface 124 comprises radio equipment (i.e. a radio transmitter and/or radio receiver) for receiving and transmitting signals using radiating arms 211, 212, 521, 522 and microstrip lines 311, 312. It is further appreciated that, as depicted, interface 124 comprises antenna feed 110 and switches 115, 116 which alternatively can be separate from interface 124 and/or separate from each other.

As depicted, device 101 further comprises a port 136 which can include, but is not limited to a USB (Universal Serial Bus) port.

While not depicted, device 101 further comprises a power source, not depicted, for example a battery or the like. In some implementations the power source can comprise a connection to a mains power supply and a power adaptor (e.g. an AC-to-DC (alternating current to direct current) adaptor).

In any event, it should be understood that a wide variety of configurations for device 101 are contemplated.

In general radiating arms 211, 212, 521, 522 and microstrip lines 311, 312 comprise antenna components that can be used in different combinations to resonate in different frequency ranges. For example, radiating arms 211, 212, 521, 522 and microstrip lines 311, 312 can be configured to operate in at least three frequency ranges. A first one of the at least three frequency ranges can comprise one or more of: a frequency range of about 698 MHz to about 960 MHz; an LTE (Long-Term Evolution) frequency range; and LTE700 frequency range. A second one of the at least three frequency ranges can comprise one or more of: about 1698 to about 2100 MHz, a GSM (Global System for Mobile Communications) frequency range; a CDMA (Code Division Multiple Access) frequency range; a PCS (Personal Communications Service) frequency range; and a UMTS (Universal Mobile Telecommunications System) frequency range. A third one of the at least three frequency ranges comprises one or more of: about 2300 to about 2700 MHz, another GSM (Global System for Mobile Communications) frequency range; another CDMA (Code Division Multiple Access) frequency range; another PCS (Personal Communications Service) frequency range; and another UMTS (Universal Mobile Telecommunications System) frequency range. Lengths, thicknesses, widths and the like of each of radiating arms 211, 212, 521, 522 and microstrip lines 311, 312can hence be configured accordingly. Switches 115, 116 can be configured to switch between combinations of radiating arms 211, 212, 521, 522 and microstrip lines 311, 312 depending on algorithms stored at memory 122, such as in application 145; such switching can depend on various parameters including, but not limited to, configurations which provide better reception, and the like.

Physical configurations of device 101, radiating arms 211, 212, 521, 522 and microstrip lines 311, 312 and ground plane 117 are next described in detail with references to FIGS. 3 through 7.

Specifically, as will be described with reference to FIGS. 3 to 5, a back side 201 of device 101 comprises a non-conducting chassis 203. First exterior radiating arm 211 is located on the exterior of a non-conducting chassis 203 and first microstrip line 311 is located on the interior of non-conducting chassis 203, first exterior radiating arm 211 and the first microstrip line 311 electrically connected through non-conducting chassis 203, the first exterior radiating arm 211 and first microstrip line 311 configured to resonate together in a first frequency range. First interior radiating arm 521 is located inside device 101, and is configured to resonate in one or more second frequency ranges higher than the first frequency range. Second exterior radiating arm 212 located on the exterior of non-conducting chassis 203 and a second microstrip line 312 is located on the interior of non-conducting chassis 203, second exterior radiating arm 212 and the second microstrip line 312 electrically connected through non-conducting chassis 203, second exterior radiating arm 212 and second microstrip line 312 configured to resonate together in the first frequency range. Second interior radiating arm 522 is located inside device 101, and is configured to resonate in the one or more of second frequency ranges. Ground plane 117 is located on the exterior of non-conducting chassis 203, each of first exterior radiating arm 211, second exterior radiating arm 212 and ground plane 117 being electrically separated from each other on the exterior of non-conducting chassis 203. Furthermore, one or more antenna feeds 110 are configured to connect to each of first microstrip line 311, second microstrip line 312, first interior radiating arm 521 and second interior radiating arm 522.

Figure 3:
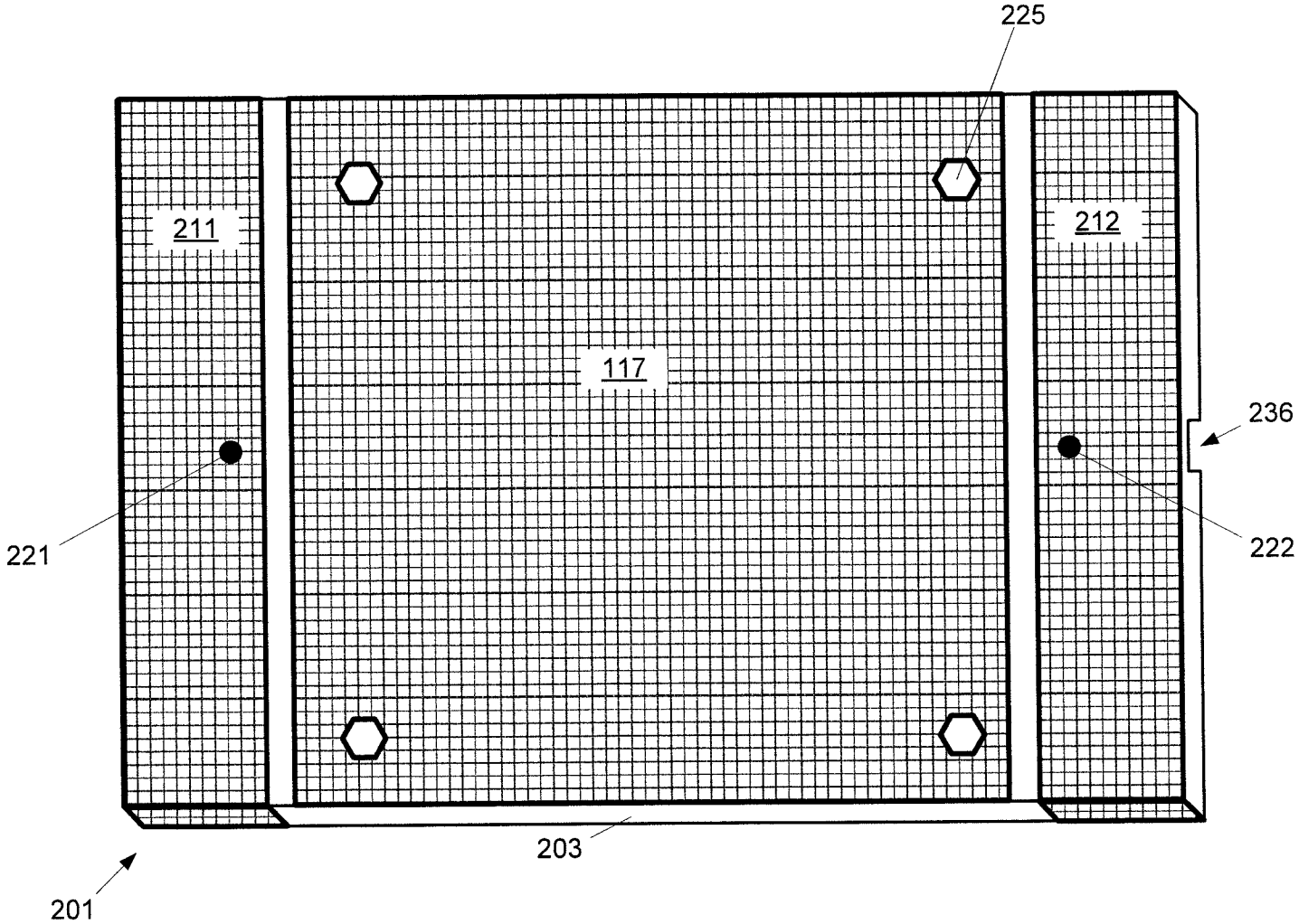
FIG. 3 depicts an exterior perspective view of back side of the device of FIG. 1, according to non-limiting implementations.
Figure 4:
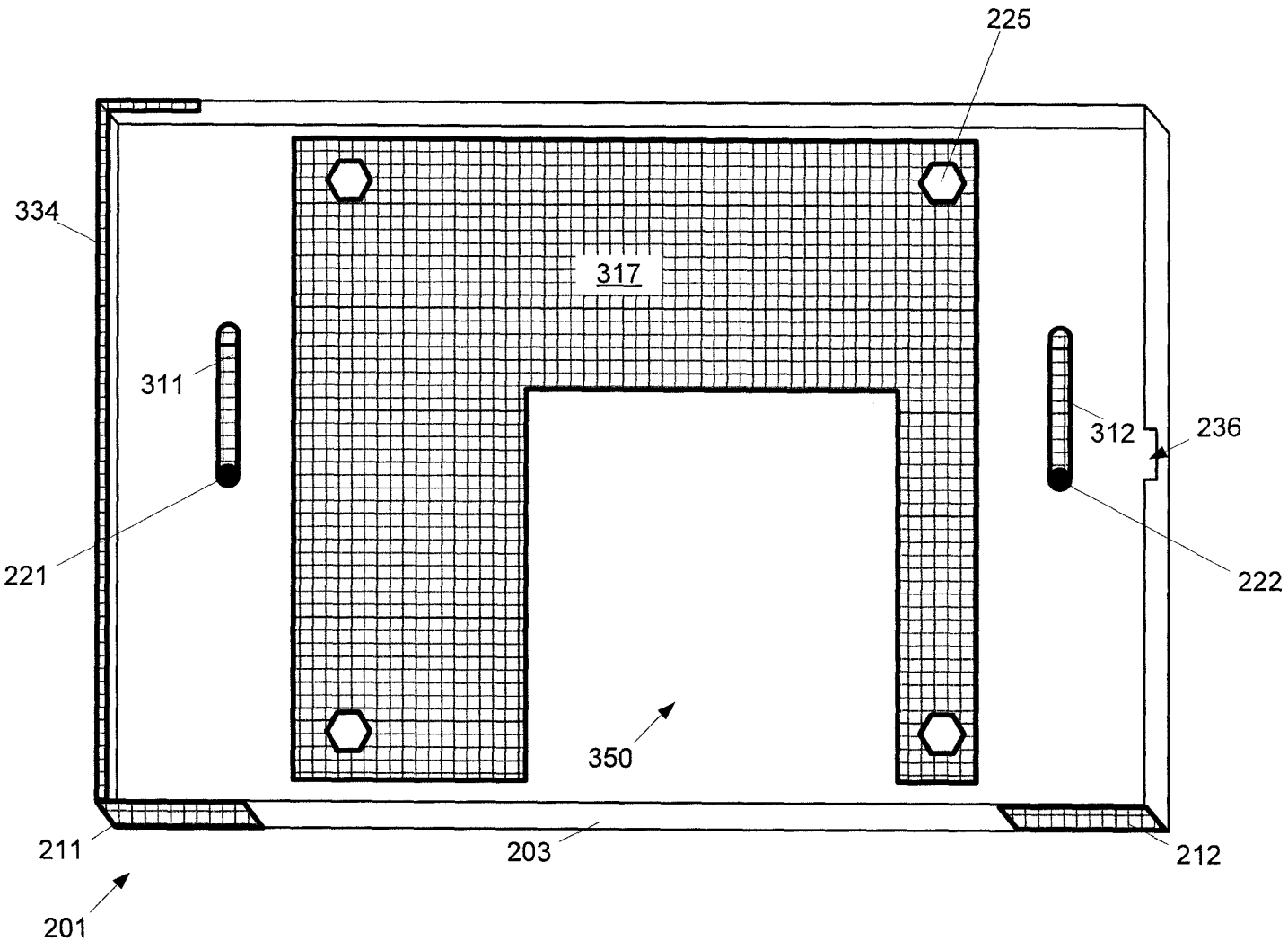
FIG. 4 depicts an interior perspective view of back side of the device of FIG. 1, according to non-limiting implementations.

Attention is next directed to FIGS. 3 and 4 which respectively depict an exterior perspective view of a back side 201 of device 101 and an interior perspective view of back side 201. Back side 201 can comprise a component of chassis 109, and is generally attachable to a remaining portion of device 101, including, but not limited to, a front portion of chassis 109 depicted in FIG. 1 and/or an internal chassis. For example, back side 201 can be removabley attached to device 101 so that a battery of device 101 can be accessed.

In any event, back side 201 comprises a non-conducting chassis 203 having an interior and an exterior, with the exterior of chassis 203 depicted in FIG. 3 and the interior of chassis 203 depicted in FIG. 4. Chassis 203 can comprise one or more of plastic, polymer and/or any other suitable non-conducting material that is non-conducting and can act as a substrate for exterior radiating arms 211, 212 and ground plane 117. In some implementations chassis 203 can comprise a cover and can be flexible so that one or more latches, hooks, and the like of back side 201 can be undone to remove the cover from device 101 so that, for example, a battery can be accessed.

Back side 201 further comprises first exterior radiating arm 211 located on the exterior of non-conducting chassis 203 and a first microstrip line 311 (visible in FIG. 4) located on the interior of non-conducting chassis 203, the first exterior radiating arm 211 and the first microstrip line 311 electrically connected through non-conducting chassis 203, as described in further detail below with reference to FIG. 6.

Back side 201 further comprises second exterior radiating arm 212 located on the exterior of non-conducting chassis 203 and a second microstrip line 312 located on the interior of non-conducting chassis 203, second exterior radiating arm 212 and second microstrip line 312 electrically connected through non-conducting chassis 203.

Back side 201 further comprises ground plane 117 located on the exterior of non-conducting chassis 203, each of radiating arms 211, 212 and ground plane 117 being electrically separated from each other on the exterior of non-conducting chassis 203. In other words, exterior radiating arms 211, 212 and ground plane 117 are separated by one or more of a gap and/or a portion of non-conducting chassis 203. In some implementations, exterior radiating arms 211, 212 and ground plane 117 are raised from non-conducting chassis 203, while in other implementations, exterior radiating arms 211, 212 and ground plane 117 are set into recesses in the exterior of non-conducting chassis 203. Furthermore, exposed portions of non-conducting chassis 203, exterior radiating arms 211, 212, and ground plane 117 can be colour matched, at least on the exterior of back side 201. Hence, back side 201 can be provided with a metallic look and feel, with integrated antennas and ground plane.

Exterior radiating arms 211, 212, microstrip lines 311, 312 and ground plane 117 each comprise one or more conducting materials suitable for antennas and/or ground planes, including, but not limited to, one or more metals. However, conducting plastics, conducting polymers, and the like are within the scope of present implementations.

Furthermore, exterior radiating arm 211 and microstrip line 311 are connected through chassis 203 using a conducting connection 221, while exterior radiating arm 212 and microstrip line 312 are connected through chassis 203 using a conducting connection 222. Respective ends of each of connections 221, 222 are depicted in FIGS. 3 and 4. Connections 221, 222 can comprise respective soldered connections, and the like, to each of radiating arms 211, 212, and microstrip lines 311, 312.

As best seen in FIGS. 3 and 4, first exterior radiating arm 211 and the first microstrip line 311 can be electrically connected through non-conducting chassis 203 at about a centre of first exterior radiating arm 211, and second exterior radiating arm 212 and second microstrip line 312 can be electrically connected through non-conducting chassis 203 at about a respective centre of second exterior radiating arm 212. In other words, connections 221, 222 can be located, respectively, at about a centre of exterior radiating arms 211, 212. However, in other implementations, connections 221, 222 can be located at any position that is compatible with the operating frequencies of radiating arms 211, 212, 521, 522 and microstrip lines 311, 312.

Indeed, as depicted, each of radiating arms 211, 212 comprise respective cap monopole antennas.

As depicted in FIG. 4, opposite ends of one or more of first exterior radiating arm 211 and the second exterior radiating arm 212 can be connected using a respective conducting strip 334 located on the interior of non-conducting chassis 203. For example, as depicted, conducting strip 334, which can comprise a metal, a conducting plastic, and the like, is located on an interior edge of chassis 203 and connects opposite ends of first exterior radiating arm 211 that wrap around sides of chassis 203. However, in other implementations, conducting strip 334 can be located on an inner face of chassis 203, similar to microstrip line 311. While in depicted implementations, there is no conducting strip connecting opposite ends of second exterior radiating arm 212 (for example, a cut-out 236 for port 136, described below, can at least partially bifurcate an adjacent edge of chassis 203), in other implementations, another conducting strip can connect opposite ends of second exterior radiating arm 212 such a conducting strip located, for example, on an interior face of chassis 203.

While as depicted in FIG. 3, ground plane 117 separates and/or is in between exterior radiating arms 211, 212, in other implementations, ground plane 117, and exterior radiating arms 211, 212 can be arranged in any manner where exterior radiating arms 211, 212 can resonate at their respective frequencies, in conjunction with their respective microstrip lines 311, 312, and/or within respective specifications (e.g. the LTE and/or LTE700 specification).

As further depicted in FIGS. 3 and 4, ground plane 117 can be attached to non-conducting chassis 203 using any suitable attachment apparatus 225, for example screws and the like (including, but not limited to screws with hexagonal heads, as depicted), though ground plane 117 could also be affixed to chassis 203 using any suitable glue, bolts, connectors, and the like. While only one attachment apparatus 225 is numbered, four are depicted in FIGS. 3 and 4, distributed along ground plane 117. While not depicted, exterior radiating arms 211, 212, and microstrip lines 311, 312 are also affixed to chassis 203 using a suitable mechanism, including, but not limited to, screws, bolts, connectors, glues and the like.

As also depicted in FIGS. 3 and 4, a portion of non-conducting chassis 203 can comprise a cut-out 236 and/or an aperture and the like for port 136.

As depicted in FIG. 4, back side 201 can comprise an internal plane 317 that can be part of ground plane 117, electrically connected to the portion of ground plane 117 on the exterior of back side 201 via apparatus 225 and/or via other electrical connecting material that can be integrated into back side 201 including, but not limited to, conducting foams and the like; such implementations can include apertures through chassis 203 so that better electrical contact can be made between ground plane 117 and internal plane 317. In these implementations, internal plane 317 can comprise a conducting material, including, but not limited to one or more metals. However, in other implementations, internal plane 317 can be configured to assist with structural integrity and/or stiffness of back side 201. In implementations, where internal plane 317 is not a component of ground plane 117, internal plane 317 can be non-conducting and can include, but is not limited to, a plastic and the like. Either way, internal plane 317 can include a cut-out 350 that corresponds to an area where a battery (not depicted) of device 101 would be located.

Figure 5:
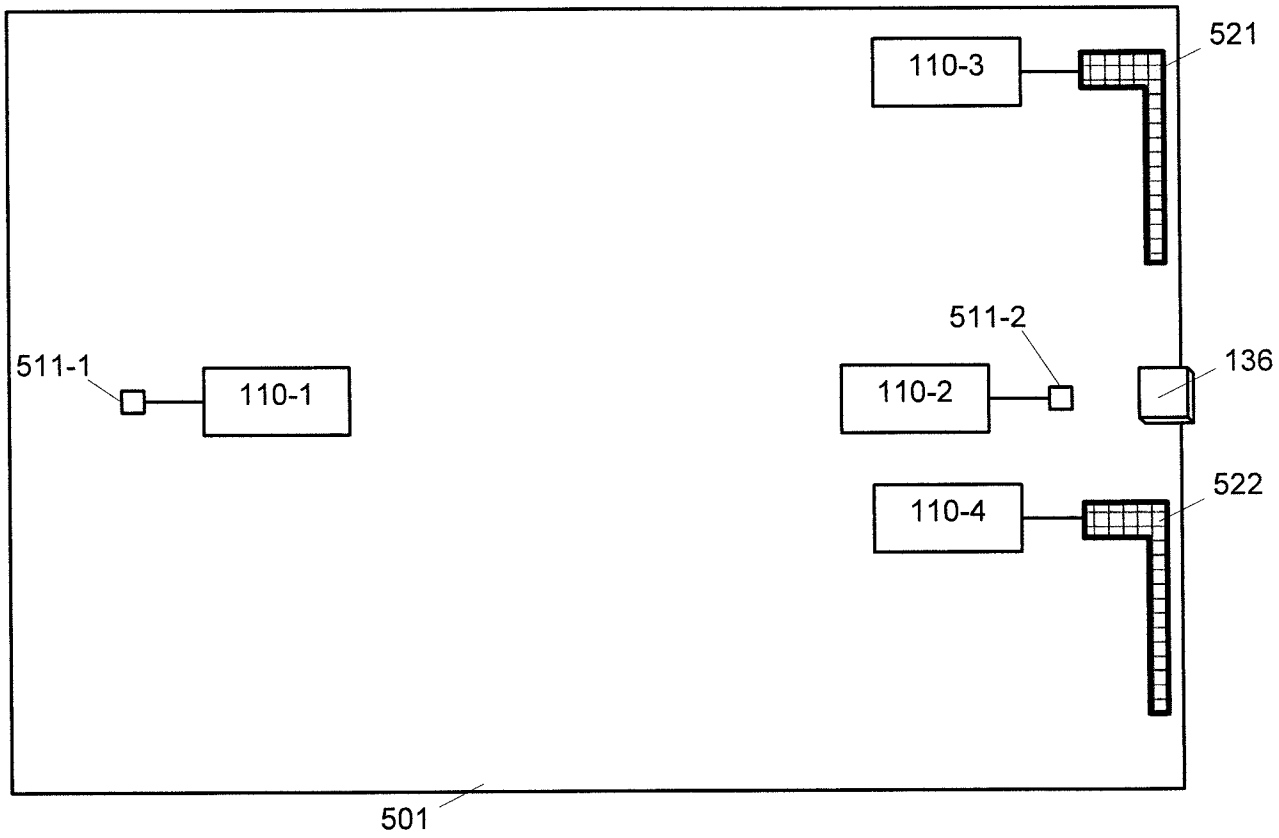
FIG. 5 depicts a perspective view of an internal chassis of the device of FIG. 1, according to non-limiting implementations.

Attention is next directed to FIG. 5 which depicts an internal chassis 501 of device 101. One or more antenna feeds 110-1, 110-2, 110-3, 110-4 are located at internal chassis 501 and, as depicted in FIG. 6 described below, antenna feeds 110-1, 110-2 are connected to first microstrip line 311 and second microstrip line 312 via respective spring contacts 511-1, 511-2 when back side 201 is in a use position with respect to internal chassis 501, for example when back side 201 is attached to device 101. However, antenna feeds 110 can be located at other positions within device 101 and are not limited to being located on internal chassis 501.

In implementations depicted in FIG. 5, internal chassis 501 comprises port 136, which corresponds to a position of cut-out 236 when back side 201 is in a use position with respect to internal chassis 501 (e. g. back side 201 is attached to device 101). Furthermore, internal chassis 501 can comprise antenna feeds 110-1, 110-2, 110-3, 110-4 (corresponding to one or more antenna feed 110 of FIG. 2), one for each radiating arm 211, 212, 521, 522.

However, in other implementations, device 101 can comprise one antenna feed 110 for radiating arms 211, 212 (and respective microstrip lines 311, 312), with switch 115 switching there between, and one antenna feed 110 for radiating arms 521, 522, with switch 116 switching there between.

In some implementations, device 101 comprises two antenna feeds 110 from interface 124 (which includes, for example, a transceiver), one main antenna feed and one diversity antenna feed. In one switch state, the main antenna feed is connected to exterior radiating arm 211 (and respective microstrip line 311), and the diversity antenna feed is connected to exterior radiating arm 212 (and respective microstrip line 312); while in the other state, the connections are reversed, for example using switch 115; such switching can occur when device 101 is in a low-band mode. Similarly, when device 101 is in one or more of a mid-band and high band mode, in one switch state, the main antenna feed is connected to interior radiating arm 521, and the diversity antenna feed is connected to interior radiating arm 522; while in the other state, the connections are reversed, for example using switch 116.

In other words, one or more of switches 115, 116 can be configured to switch between using one of a first combination of first exterior radiating arm 211 and first microstrip line 311, and a second combination of second exterior radiating arm 212 as a main antenna, and the other of the first combination and the second combination as a diversity antenna, in a low-band mode. Furthermore, one or more of switches 115, 116 can be configured to switch between using first interior radiating arm 521 and second interior radiating arm 522 as a main antenna and the other of first interior radiating arm 521 and second interior radiating arm 522 as a diversity antenna, in one or more of a mid-band mode and a high-band mode. Indeed, processor 120 can be configured to switch between a low-band mode and one or more of a mid-band mode and a high-band mode, and selection of antenna components as a main antenna or a diversity antenna made accordingly, for example using an antenna selection table.

While not depicted, internal chassis 501 can comprise other internal components of device 101, including, but not limited to processor 120, memory 122, switches 115, 116 and the like, as well as one or more PCBs (printed circuit boards), computer buses, and the like.

Furthermore, in depicted implementations, port 136 (which can include, but is not limited to USB port) is located at an edge of, and extends from internal chassis 501 so that port 136 extends through a side of device 101 for example through cut-out 236. Also as depicted, first interior radiating arm 521 and second interior radiating arm 522 can be located on either side of the one or more of port 136 and a USB port on an interior of device 101, for example on either side of port 136 on internal chassis 501.

In the specific non-limiting implementations depicted in FIG. 5, each of first interior radiating arm 521 and second interior radiating arm 522 comprise a respective inverted L-monopole antenna, each of a size and configuration compatible with respective operating frequencies. In general, as first interior radiating arm 521 and second interior radiating arm 522 act as mid-band and/or high-band antennas with respect to exterior radiating arms 211, 212, a size and configuration of each of first interior radiating arm 521 and second interior radiating arm 522 is smaller than a size and configuration of exterior radiating arms 211, 212.

Indeed, lengths, widths, thicknesses and/or locations of each section of each of radiating arms 211, 212, 521, 522 and microstrip lines 311, 312 can be selected so that radiating arms 211, 212, 521, 522 and microstrip lines 311, 312 resonate at a given set of frequencies, for example those described above.

Figure 6:
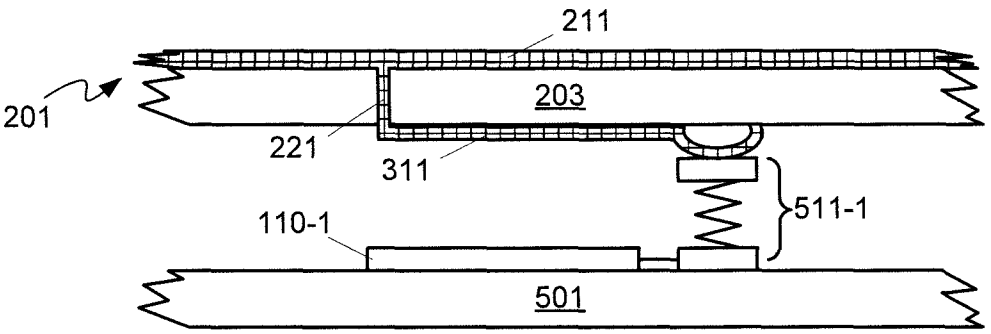
FIG. 6 depicts a partial cross section of the back side of FIGS. 2 and 3, in a use position with respect to the internal chassis of FIG. 5, according to non-limiting implementations.
Figure 7:
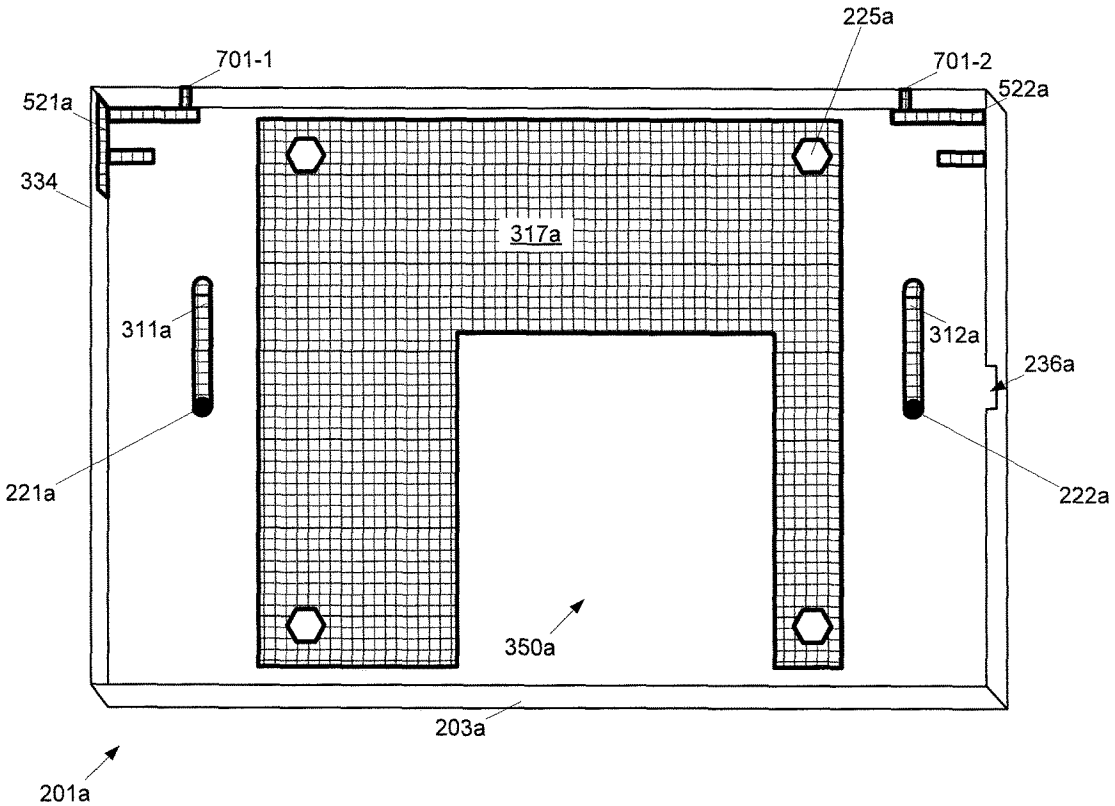
FIG. 7 depicts an interior perspective view of back side of the device of FIG. 1, according to alternative non-limiting implementations.

Attention is next directed to FIG. 6 which depicts a portion of back side 201 in cross-section through a longitudinal axis of first microstrip line 311, as well as a cross-section of internal chassis 501 when back side 201 is in a use position with respect to internal chassis 501. As depicted in FIG. 6, antenna feed 110-1 is in electrical connection with spring contact 511-1, which is, in turn, in electrical contact with an end of first microstrip line 311 that is opposite connection 221 through non-conducting chassis 203. As depicted, an end of first microstrip line 311 that is in contact with spring contact 511-1 is raised from chassis 203 and/or is rounded to make better contact with spring contact 511-1 and/or to compress spring contact 511-1. However, such a raised and/or rounded configuration of microstrip line 311 is optional. As depicted, spring contact 511-1 comprises a conducting spring and conducting pads on opposite ends of the spring that respectively electrically connect to antenna feed 110-1 and microstrip line 311, however the functionality of spring contact 511-1 can be implemented through other configurations. It is further apparent from FIG. 6, as well as FIGS. 4 and 5, that a location of spring contact 511-1 on internal chassis 501 is positioned so that spring contact 511-1 aligns with an end of microstrip line 311 when back side 201 is in a use position with respect to internal chassis 501.

FIG. 6 further shows that connection 221 is through non-conducting chassis 203 and electrically connects first microstrip line 311 with first exterior radiating arm 211, so that antenna feed 110-1 can drive the combination of first exterior radiating arm 211 and first microstrip line 311.

While not depicted second exterior radiating arm 212, second microstrip line 312, connection 222, spring contact 511-2 and antenna feed 110-2 can have a similar structure, arrangement and/or configuration as that depicted in FIG. 6.

While not depicted, in some implementations, ground plane 117 can be electrically connected to a grounding portion of one or more antenna feeds 110 when back side 201 is in a use position at device 101. In other words, while not depicted, further spring contacts can be in electrical connection with internal plane 317 and/or electrical connectors to ground plane 117 when back side 201 is in a use position at device 101.

However, in further implementations, ground plane 117 can comprise a parasitic ground plane.

Indeed, ground plane 117 can be configured either as a floating ground plane or as a parasitic ground plane, with configurations of radiating arms 211, 212, 521, 522 and microstrip lines 311, 312 selected accordingly.

Persons skilled in the art will appreciate that there are yet more alternative implementations and modifications possible. For example, in further implementations, a first exterior radiating arm, and a second exterior radiating arm can be located on the interior of a non-conducting chassis of a back cover of device 101. For example, attention is next directed to FIG. 7 which depicts an interior of an alternative non-limiting implementation of a back side 201*a*, which is otherwise substantially similar to back side 201, with like elements having like numbers with an "a" appended thereto. Indeed, an exterior of back side 201*a* can be similar to the exterior of back side 201 as depicted in FIG, 3, though each of exterior radiating arms 211, 212 need not extend along an exterior side of back side 201*a*. However, in other implementations, each of exterior radiating arms 211, 212 can extend along an exterior side of back side 201*a*. In any event, back side 201*a* further comprises microstrip lines 311*a*, 312*a*, located on a non-conducting chassis 203*a*, connections 221*a*, 222*a* there through respectively to exterior radiating arms 211, 212, an internal plane 317*a* and connectors 225*a* which can electrically connect internal plane 317*a* to ground plane 117 (not depicted, but understood to be located on an exterior of back side 201*a*). Back side 201*a* further comprises a cut-out 236*a* in non-conducting chassis 203*a* for port 136. While not depicted, internal plane 317*a* can be in electrical connection with ground plane 117 on an exterior of back side 201*a* using apertures through non-conducting chassis 203, and conducting foam, conducting tape and the like. As with internal plane 317, internal plane 317*a* comprises a cut-out 350*a* corresponding to a battery position.

However, in contrast to back side 201, back side 201*a* comprises a first interior radiating arm 521*a* and a second interior radiating arm 522*a* located on the interior of non-conducting chassis 203*a* of back side 201. Specifically, each of first interior radiating arm 521*a* and second interior radiating arm 522*a* comprise a respective PIFA (Planar Inverted-F Antenna), configured to resonate in frequency ranges as described above with respect to first interior radiating arm 521 and second interior radiating arm 522. Electrical connections to respective antenna feeds 110 can be made through suitably located spring contacts, similar to spring contacts 511-1, 511-2. Furthermore, a portion of each interior radiating arms 521*a*, 522*a* can be located along an internal side of chassis 203, for example a long portion of each "F" shape of each interior radiating arms 521*a*, 522*a* with the respective cross-portions of each "F"shape bent away from each respective long portion along an internal face of chassis 203*a*. While not all of interior radiating arm 522*a* is visible in FIG. 7, it is appreciated that interior radiating arm 522*a* is a mirror image of interior radiating arm 521*a*. Furthermore, each interior radiating arms 521*a*, 522*a* is located in a corner of chassis 203 adjacent to a respective exterior radiating arms 211, 212 (i.e. comparing FIGS. 3 and 7, interior radiating arm 521*a* is located in a corner adjacent external radiating arm 211, and interior radiating arm 522*a* is located in a corner adjacent external radiating arm 212).

In some implementations, ground plane 117 and internal plane 317*a* can act as a ground plane for one or more of radiating arms 211, 212, 521, 522 and microstrip lines 311, 312 through suitable connections thereto. However, in other implementations, one or more of radiating arms 211, 212, as depicted, can be configured as a ground plane for a respective PIFA (i.e. a respective interior radiating arm 521*a*, 522*a*). For example, as depicted, each of interior radiating arms 521*a*, 522*a* comprise a respective connection 701-1, 701-2 (including, but not limited to a microstrip line) that extends along an interior side of chassis 203*a* and around to an exterior side to electrically connect to respective exterior radiating arms 211, 212 which acts as a ground plane. Put another way, a short of a PIFA can be connected to a respective exterior radiating arm.

In any event, described herein is an antenna system for mobile handsets with a predominantly metal back cover. The antenna system consists of four antennas, two cap-monopole antennas that cover the Low-band that form part of an exterior of the back cover, and two inverted-L antennas that cover the mid and high-bands. In another variation of the antenna solution, the two mid and high-bands antennas can be implemented as PIFAs integrated into the back cover. Each implementation further includes a ground plane integrated into an exterior of the back cover that is electrically isolated from each of the low-band antennas along the exterior of the back cover.

Those skilled in the art will appreciate that in some implementations, the functionality of device 101 can be implemented using pre-programmed hardware or firmware elements (e.g., application specific integrated circuits (ASICs), electrically erasable programmable read-only memories (EEPROMs), etc.), or other related components. In other implementations, the functionality of device 101 can be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Furthermore, it is appreciated that the computer-readable program can be stored as a computer program product comprising a computer usable medium. Further, a persistent storage device can comprise the computer readable program code. It is yet further appreciated that the computer-readable program code and/or computer usable medium can comprise a non-transitory computer-readable program code and/or non-transitory computer usable medium. Alternatively, the computer-readable program code could be stored remotely but transmittable to these components via a modem or other interface device connected to a network (including, without limitation, the Internet) over a transmission medium. The transmission medium can be either a non-mobile medium (e.g., optical and/or digital and/or analog communications lines) or a mobile medium (e.g., microwave, infrared, free-space optical or other transmission schemes) or a combination thereof.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever.

Persons skilled in the art will appreciate that there are yet more alternative implementations and modifications possible, and that the above examples are only illustrations of one or more implementations. The scope, therefore, is to be limited by the claims appended here.

What is claimed is:

1. A device comprising:

a back cover comprising a non-conducting chassis having an interior surface and an exterior surface;

an internal chassis separated from the back cover;

a first exterior radiating arm located on the exterior surface of the non-conducting chassis of the back cover and a first microstrip line located on the interior surface of the non-conducting chassis of the back cover, the first exterior radiating arm and the first microstrip line electrically connected through the non-conducting chassis of the back cover, the first exterior radiating arm and the first microstrip line configured to resonate together in a first frequency range;

a first interior radiating arm located inside the device, and configured to resonate in one or more second frequency ranges higher than the first frequency range;

a second exterior radiating arm located on the exterior surface of the non-conducting chassis of the back cover and a second microstrip line located on the interior surface of the non-conducting chassis of the back cover, the second exterior radiating arm and the second microstrip line electrically connected through the non-conducting chassis of the back cover, the second exterior radiating arm and the second microstrip line configured to resonate together in the first frequency range;

a second interior radiating arm located inside the device, and configured to resonate in the one or more of second frequency ranges;

a ground plane located on the exterior surface of the non-conducting chassis of the back cover, each of the first exterior radiating arm, the second exterior radiating arm and the ground plane being electrically separated from each other on the exterior surface of the non-conducting chassis of the back cover; and, one or more antenna feeds located on the internal chassis, the one or more antenna feeds configured to connect to each of the first microstrip line and the second microstrip line at a respective end opposite a connection to a respective exterior radiating arm through the non-conducting chassis of the back cover, the one or more antenna feeds further configured to connect to the first interior radiating arm and the second interior radiating arm.

2. The device of claim 1, wherein the ground plane separates the first exterior radiating arm from the second exterior radiating arm.

3. The device of claim 1, further comprising one or more of a port and a USB (Universal Serial Bus) port through a side of the device, the first interior radiating arm and the second interior radiating arm located on either side of the one or more of the port and the USB port on an interior of the device.

4. The device of claim 1, wherein each of the first interior radiating arm and the second interior radiating arm comprise a respective inverted L-monopole antenna.

5. The device of claim 1, wherein each of the first interior radiating arm and the second interior radiating arm are located on an interior chassis.

6. The device of claim 1, wherein each of the first interior radiating arm and the second interior radiating arm are located on the interior surface of the non-conducting chassis of the back cover.

7. The device of claim 1, wherein each of the first interior radiating arm and the second interior radiating arm comprise a respective PIFA (Planar Inverted-F Antenna).

8. The device of claim 7, wherein one or more of the first exterior radiating arm and the second exterior radiating arm is configured as a ground plane for the respective PIFA.

9. The device of claim 1, wherein each of the first interior radiating arm and the second interior radiating arm are configured to resonate in one or more of: a GSM (Global System for Mobile Communications) frequency range; a CDMA (Code Division Multiple Access) frequency range; a PCS (Personal Communications Service) frequency range; and a UMTS (Universal Mobile Telecommunications System) frequency range.

10. The device of claim 1, wherein the ground plane comprises a parasitic ground plane.

11. The device of claim 1, wherein the back cover is removable from the device, and the ground plane is electrically connected to a grounding portion of the one or more antenna feeds when the back cover is attached to the device.

12. The device of claim 1, wherein the back cover is removable, and the one or more antenna feeds are connected to the respective end of each of the first microstrip line and the second microstrip line via respective spring contacts when the back cover is attached to the device.

13. The device of claim 1, wherein opposite ends of one or more of the first exterior radiating arm and the second exterior radiating arm are connected using a respective conducting strip, the respective conducting strip located on the interior surface of the non-conducting chassis of the back cover.

14. The device of claim 1, wherein the first exterior radiating arm and the first microstrip line are electrically connected through the non-conducting chassis of the back cover at about a centre of the first exterior radiating arm, and the second exterior radiating arm and the second microstrip line are electrically connected through the non-conducting chassis of the back cover at about a respective centre of the second exterior radiating arm.

15. The device of claim 1, wherein each of the first exterior radiating arm and the second exterior radiating arm comprise respective cap monopole antennas.

16. The device of claim 1, wherein the first frequency range comprise one or more of: a frequency range of about 698MHz to about 960MHz; an LTE (Long-Term Evolution) frequency range; and LTE700 frequency range; and the one or more second frequency ranges comprise one or more of: about 1710 to about 2100MHz, about 2300 to about 2700MHz one or more GSM (Global System for Mobile Communications) frequency ranges; one or more CDMA (Code Division Multiple Access) frequency ranges; one or more PCS (Personal Communications Service) frequency ranges; and one or more UMTS (Universal Mobile Telecommunications System) frequency ranges.

17. The device of claim 1, further comprising one or more switches configured to switch between using one of a first combination of the first exterior radiating arm and the first microstrip line, and a second combination of the second exterior radiating arm as a main antenna, and the other of the first combination and the second combination as a diversity antenna, in a low-band mode.

18. The device of claim 1, further comprising one or more switches configured to switch between using the first interior radiating arm and the second interior radiating arm as a main antenna and the other of the first interior radiating arm and the second interior radiating arm as a diversity antenna, in one or more of a mid-band mode and a high-band mode.

19. The device of claim 1, further comprising a processor configured to switch between a low-band mode and one or more of a mid-band mode and a high-band mode.

20. The device of claim 1, wherein exposed exterior portions of the non-conducting chassis of the back cover, the first exterior radiating arm, the second exterior radiating arm, and the ground plane are colour matched.

* * * * *